US009725962B2

(12) United States Patent
Fischer

(10) Patent No.: US 9,725,962 B2
(45) Date of Patent: Aug. 8, 2017

(54) DRILL STRING, CONNECTION SYSTEM, EARTH DRILLING DEVICE AND METHOD TO CONNECT A DRILL STRING SECTION

(71) Applicant: TRACTO-TECHNIK GmbH & Co. KG, Lennestadt (DE)

(72) Inventor: Sebastian Fischer, Lennestadt (DE)

(73) Assignee: TRACTO-TECHNIK GMBH & CO. KG, Lennestadt (DE)

( * ) Notice: Subject to any disclaimer, the term of this patent is extended or adjusted under 35 U.S.C. 154(b) by 0 days.

(21) Appl. No.: 14/956,980

(22) Filed: Dec. 2, 2015

(65) Prior Publication Data

US 2016/0160573 A1 Jun. 9, 2016

(30) Foreign Application Priority Data

Dec. 5, 2014 (DE) ..... 10 2014 018 102

(51) Int. Cl.

| | |
|---|---|
| ***E21B 17/02*** | (2006.01) |
| ***E21B 17/03*** | (2006.01) |
| ***E21B 17/04*** | (2006.01) |
| ***E21B 17/046*** | (2006.01) |

(52) U.S. Cl.
CPC ..... *E21B 17/02* (2013.01); *E21B 17/03* (2013.01); *E21B 17/046* (2013.01)

(58) Field of Classification Search
CPC ..... E21B 17/02; E21B 17/03; E21B 17/04; E21B 17/046; E21B 17/0423; E21B 17/043
See application file for complete search history.

(56) References Cited

U.S. PATENT DOCUMENTS

| | | | | |
|---|---|---|---|---|
| 1,857,420 | A * | 5/1932 | Wolford | F16L 37/252 285/360 |
| 2,309,866 | A | 2/1943 | Reed | |
| 3,032,360 | A * | 5/1962 | Woodings | E21B 17/04 279/44 |
| 3,275,354 | A * | 9/1966 | Sutliff | E21B 17/046 267/169 |
| 4,361,196 | A | 11/1982 | Hoyle, Jr. | |
| 4,986,690 | A * | 1/1991 | Cooksey | E21B 17/02 403/27 |
| 5,403,043 | A * | 4/1995 | Smet | F16L 37/2445 285/148.21 |
| 5,651,570 | A | 7/1997 | Schrum et al. | |
| 6,151,810 | A | 11/2000 | Mukai | |
| 6,283,511 | B1 * | 9/2001 | Kamp | E21B 17/0426 285/334.4 |
| 8,858,111 | B2 * | 10/2014 | Donohue | B25G 1/04 403/348 |

(Continued)

FOREIGN PATENT DOCUMENTS

| | | |
|---|---|---|
| DE | 9005954 U1 | 8/1990 |
| DE | 4116771 A1 | 11/1992 |
| EP | 0458289 B1 | 11/1991 |

*Primary Examiner* — Matthew R Buck

(74) *Attorney, Agent, or Firm* — Howard IP Law Group, PC

(57) ABSTRACT

A drill string section includes at least one plug-and-rotate seat (bayonet seat) for interacting with a (bayonet) catch, wherein the seat allows an additional plug-in step for fixing the catch in a connection secure against rotation in both directions of rotation about the longitudinal axis of the drill string section.

17 Claims, 4 Drawing Sheets

(56) References Cited

U.S. PATENT DOCUMENTS

| | | | | |
|---|---|---|---|---|
| 9,127,513 | B2 * | 9/2015 | Matthias | E21B 17/046 |
| 2005/0042943 | A1 * | 2/2005 | Mocivnik | E21B 17/03<br>439/894 |
| 2012/0205908 | A1 * | 8/2012 | Fischer | E21B 7/002<br>285/331 |

* cited by examiner

DRILL STRING, CONNECTION SYSTEM, EARTH DRILLING DEVICE AND METHOD TO CONNECT A DRILL STRING SECTION

CROSS-REFERENCE TO RELATED APPLICATIONS

This application claims priority pursuant to 35 U.S.C. 119(a)-(d) to German Application No. 10 2014 018 102.2 filed Dec. 5, 2014, the subject matter incorporated herein by reference.

FIELD OF INVENTION

The invention relates to a drill string section, a connection system of an earth drilling device, an earth drilling device, and a method for connecting a drill string section.

BACKGROUND

Earth drilling devices, in particular horizontal drilling devices, are used to introduce earth drill holes into the soil by trenchless construction for supply and waste lines, for example, or to replace already installed old lines without a trench. To introduce the earth drill hole, generally a drill string having drill string sections is used, wherein the drill string sections are connectable to each other, to drill heads and/or a drive.

It is known to design drill string sections such that the drill string sections have an inner thread at one end and an outer thread at the other end. The end of a drill string section having the outer thread can accordingly be screwed into a corresponding inner thread in another drill string section, or vice versa.

It is known from DE 41 16 771 C2 to connect drill string sections by means of a quick coupling. The quick coupling can be a bayonet lock fixed against rotation in at least one direction which is capable of absorbing both tractive, thrust and rotary forces. The drill string sections known from DE 41 16 771 C2 can be connected to each other secure against tension and thrust by being axially plugged together and subsequently rotated radially. DE 41 16 771 C2 describes the use of a cross pin to secure the connection against rotating.

A disadvantage of the known prior art, is the use of an additional component (the cross pin) in order to establish a connection secure against rotation in both directions of rotation about the longitudinal axis of the drill string sections. Additional material and procedural steps are needed to connect the drill string sections and disconnect them after creating the earth drill hole. In particular, removing the cross pin can be difficult and/or time-consuming due to the harsh conditions while drilling in the earth.

SUMMARY

An object of the invention was therefore to present an improved drill string section which allows a simpler design of a connection secure against rotation in both axial directions of rotation. Furthermore, an improved connection system was to be established as well as an improved earth drilling device. In addition, a method was to be presented which allows an improved connection of a drill string section.

An underlying concept of the invention is that of developing a bayonet connection consisting of a plug-and-rotate connection such that an additional plug-in step is executed beyond the steps of plugging and rotating by realizing a connection secure against rotation about the longitudinal axis of the drill string section. In particular, paddle operation of the drill string is possible with the drill string section.

According to the invention, a "drill string section" comprises a drill string section of an earth drilling device. An "earth drilling device" is in particular understood to be any device that moves a drill string having drill string sections within a channel that exists or is to be created in the soil in order to create or expand a hole, in particular a horizontal drill hole, or to pull lines or other long bodies into the soil. The earth drilling device can in particular be an HD (horizontal drilling) device. An "earth drilling device" according to the invention comprises a device that drives a drill string and works by displacing soil, and the drill string can be driven in a rotating manner, at least over a partial angular range in the direction of the longitudinal axis of the drill string. If the drill string is moved over an angular range in both directions of rotation in the direction of the longitudinal axis of the drill string, the term paddle operation is used.

According to the present invention, the term "HD" comprises in particular any type of preferably horizontal channels, or channels at an incline relative to the horizontal, in a body that exist or are to be created, in particular earth channels including earth drill holes, rock drill holes or ground lines as well as underground or above-ground pipelines and water channels that can be produced or pulled in by using a corresponding earth drilling device.

A drill string section according to the invention has at least, in particular on an end side, one plug-and-rotate seat, a so-called bayonet seat, for interacting with a catch, the so-called bayonet catch. In addition to the plug-and-rotate seat, the seat allows an additional plug-in step for fixing the catch in a connection secure against rotation in both directions of rotation about the longitudinal axis of the drill string section.

The seat which in particular can be arranged on the end-side of the drill string section makes it possible to inset the drill string section and catch by means of plugging, wherein the drill string section and catch are aligned with each other in the longitudinal direction of the drill string section. After axially plugging the drill string section in the axial direction relative to the catch, the drill string section can be rotated about the longitudinal axis relative to the catch such that the drill string section and catch are no longer flush in the plugging direction, so that the drill string section and catch can no longer be separated in the plugging direction, or opposite thereto. The connection obtained by the plug-and-rotate steps is thus secure against tension. After the drill string section and catch have been rotated relative to each other, the seat permits an additional plug-in step, in particular in the longitudinal direction of the drill string section, in order to cause the surfaces that interact during rotation (in the rotation step) to no longer be flush, and enables rotating against the rotation to form the connection to not release the drill string connection from the catch. Due to the additional plug-in step, the drill string section and catch can be fixed such that a connection secure against rotation about the longitudinal axis of the drill string section in both directions of rotation is possible. Due to the additional plug-in step, the drill string section and catch can be aligned such that the drill string section and catch have interacting surfaces which come in to contact with each other in the additional plug-in step and fix the drill string section and catch securely against rotation in both directions of rotation.

A drill string section according to the invention therefore enables a simple design of a connection having a catch in which a rotational movement of the drill string section in both directions of rotation about the longitudinal axis of the drill string section is possible. In addition, the drill string section makes it possible to retrieve the drill string by means of a pulling movement since the catch can be rotated relative to the drill string section by the formation of a rotation between the drill string section and catch and a prior alignment and plugging of the drill string section and catch into each other so that an inner contour of the catch and an outer contour of a drill string section are no longer flush. In addition to the pulling movement by means of which the drill string can be retrieved, a possible rotational movement to disconnect in one direction is possible, i.e., in the direction to form the connection in the rotation step.

The catch can be formed on a drill string section according to the invention such that the catch is formed on one end of a drill string section, and a corresponding seat for the catch is formed on the other end of the drill string section. However, it can also be provided that the drill string section only has a seat for the catch on one end. In particular, it can be provided that a drill string section on the front end of the drill string connected to the drill head only has a seat for the catch at one end, and a different type of connection is provided at the other end. Furthermore, it can also be provided that another connecting element is formed on the end-side area of the drill string section on which the (bayonet) seat is fashioned. For example, a conical thread can also be formed on the end side by means of which the drill string sections can be screwed to each other, and the catch is only formed on the drive or a slide of an earth drilling device.

With regard to the referenced noun, the term "at least one" used in the claims or the description, as well as the indefinite article "a" used in the claims and the description, and the corresponding grammatical forms in terms of gender and declension, are precisely one or more, i.e., two, three, four, etc. of the elements designated by the noun.

In one preferred embodiment, the seat of the drill string section according to the invention has an aligning section, a rotating section and a paddle section. The three sections of the seat can enable the individual steps for forming the connection, i.e., plugging, rotating and plugging. By means of the aligning section, the drill string section and the catch can be aligned axially so that plugging can occur after alignment relative to each other. By means of the rotating section, the drill string section and catch can be rotated relative to each other about the longitudinal axis, preferably by 45°. The paddle section enables the plugging of the drill string section and catch required after the relative rotation of the drill string section and catch. The plugging according to the invention is accomplished by a relative movement of the drill string section and catch in an axial direction towards each other. In the paddle section, acting surfaces of the drill string section and catch exist in both directions of rotation which are in contact with each other in order to ensure a connection secure against rotation in both directions of rotation. With reference to the end of the drill string section at which the connection is formed, the aligning section is at a closer distance than the rotating section and paddle section. The rotating section is at a closer distance to the end of the drill string section at which the connection is to be formed than the paddle section. In particular, the aligning section, rotating section and paddle section can directly follow each other viewed from the end of the drill string section on which the connection is to be formed.

In one preferred embodiment, the seat has an axial seat surface and a paddle surface for the catch. The axial seat surface is a surface facing the catch or the end of the drill string section against which a surface of the catch contacts in the additional plugging step, and terminates the movement between the drill string section and catch in the plugging step. The paddle surface for the catch ensures the connection secure against rotation, wherein a corresponding surface of the catch lies against the paddle surface. The contact surface can in particular have a surface normal which runs parallel to the longitudinal axis of the drill string section. The paddle surface can in particular have a surface normal which is parallel to a radial direction. More than one contact surface and/or more than one paddle surface can be provided. For example, there can be four paddle surfaces. Less surface pressure can result.

In one preferred embodiment, two paddle surfaces are formed on the drill string section which are arranged at an angle offset to the longitudinal axis of the drill string section. By forming two paddle surfaces, a secure formation of the connection secure against rotation in the two directions of rotation is possible. One paddle surface can be provided for the catch for each of the two directions of rotation.

Preferably, one section is designed to align the drill string section with the catch along the longitudinal axis (aligning section), which section has a projection in an angular range about the longitudinal axis of the drill string section in comparison to another section in which the catch is rotatable about the longitudinal axis of the drill string section (rotating section). The projection can be designed such that the catch, after the catch has been rotated relative to the drill string section, blocks a stop for an axial movement of the catch relative to the drill string section. The term "projection" can comprise a macroscopic elevation on a peripheral surface of the drill string section. The macroscopic elevation can preferably be locally limited. The elevation can project relative to the surface. In particular, the projection can project relative to a lateral surface of the rotating section. In particular, four projections can be formed.

The section for aligning the drill string section with regard to the longitudinal axis is preferably designed symmetrical so that one or more projections which are provided as a stop for limiting an axial relative movement between the drill string section and catch are formed at an offset angle to each other at an equidistant angle about the longitudinal axis of the drill string section.

In one preferred embodiment, the longitudinal axial extension of the section in which the catch is rotatable about the longitudinal axis of the drill string section (rotating section) is essentially the same as the longitudinal axial extension of an inner contour of the catch so that the drill string section and catch can be rotated relative to each other, and the rotation is guided in the longitudinal axial direction.

In one preferred embodiment, the section in which the catch is rotatable about the longitudinal axis of the drill string section (rotating section) has a longitudinal movement stop surface and a rotating movement stop surface which are arranged relative to each other such that the catch, when brought into contact with the rotating movement stop surface, is out of contact with the longitudinal movement stop surface, and the catch is pluggable relative to another section (paddle section).

The invention also establishes a connecting system of an earth drilling device for connecting an above-cited drill string section with a catch, as well as an earth drilling device with one of the above-cited drill string sections.

Furthermore, the invention establishes a method for connecting a drill string section to a catch, wherein the method comprises the steps: Plugging in the drill string section relative to the catch in the longitudinal direction of the drill string section, rotating the drill string section relative to the catch about the longitudinal axis of the drill string section, and plugging in the drill string section relative to the catch in the longitudinal direction of the drill string section, wherein the catch is brought into contact with the drill string section such that a connection secure against rotation is formed in both directions of rotation relative to the longitudinal axis of the drill string section.

The above statements, and likewise the following description of exemplary embodiments, do not constitute a relinquishment of specific embodiments or features.

BRIEF DESCRIPTION OF THE DRAWINGS

The invention is explained in greater detail below based on an exemplary embodiment shown in the drawings.

In the drawings.

DETAILED DESCRIPTION OF PREFERRED EMBODIMENTS

Figure 1:
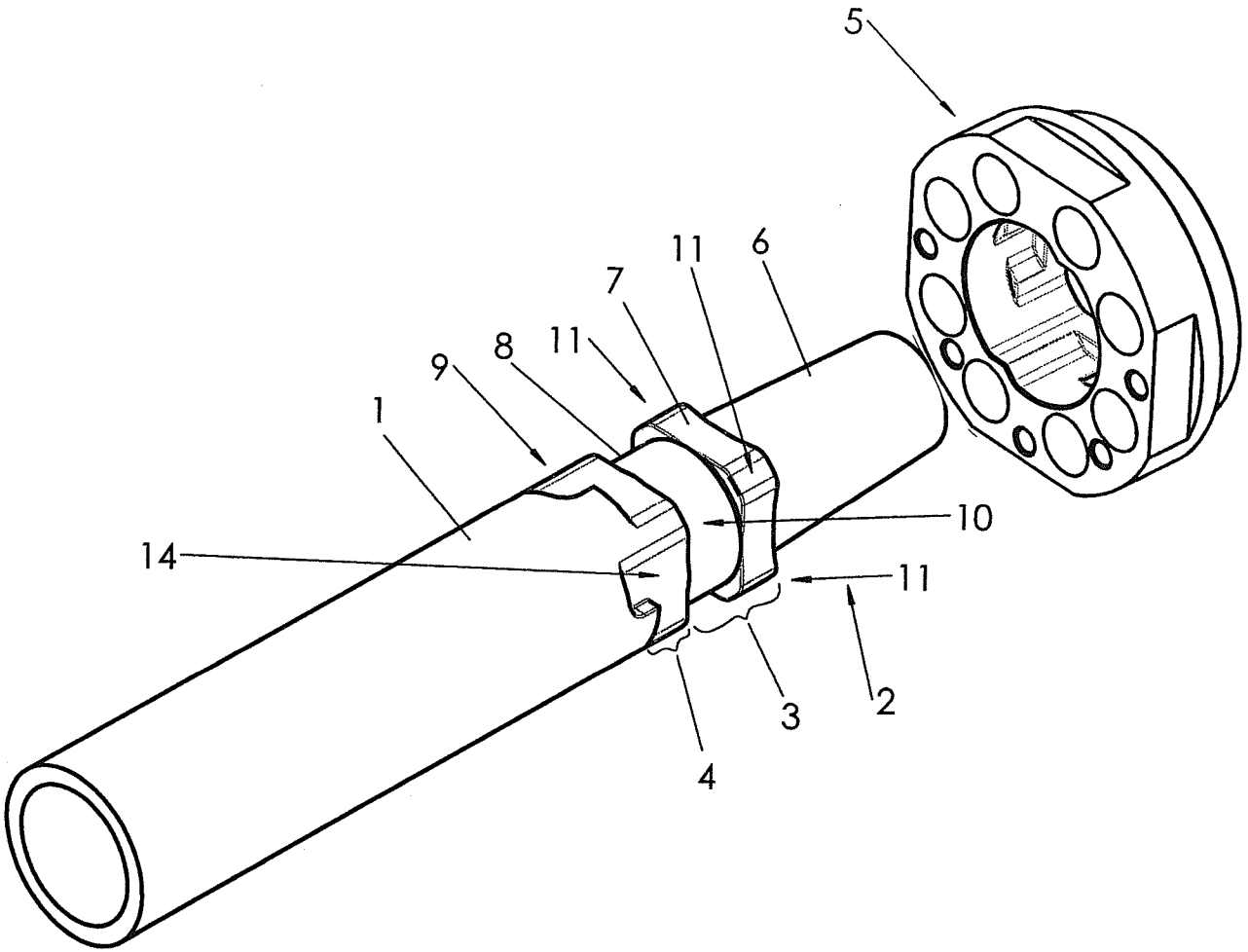
FIG. 1 shows an isometric representation of an end-side area of a drill string section and a catch.

FIG. 1 schematically portrays an end-side area of a drill string section 1 which has a seat 2 that comprises a plug-and-rotate seat 3. Furthermore, the seat 2 has a section 4 which permits an additional plug-in step for fixing a catch 5, wherein in the additional plug-in step, the catch 5 is positioned relative to the drill string section 1 and the seat 2 of the drill string section 1 such that the catch 5 lies against the drill string section 1 in a nonrotating manner in both directions of rotation.

The end-side area of the drill string section 1 has a conical end 6 which abuts an aligning section 7. On the end 6, an outer thread can be formed which is designed to correspond with an inner thread of another drill string section. At a distance from the depicted end of the drill string section 1, a rotating section 8 is formed on which a paddle section 9 is formed at a still greater distance from the end of the drill string section 1.

Figure 2:
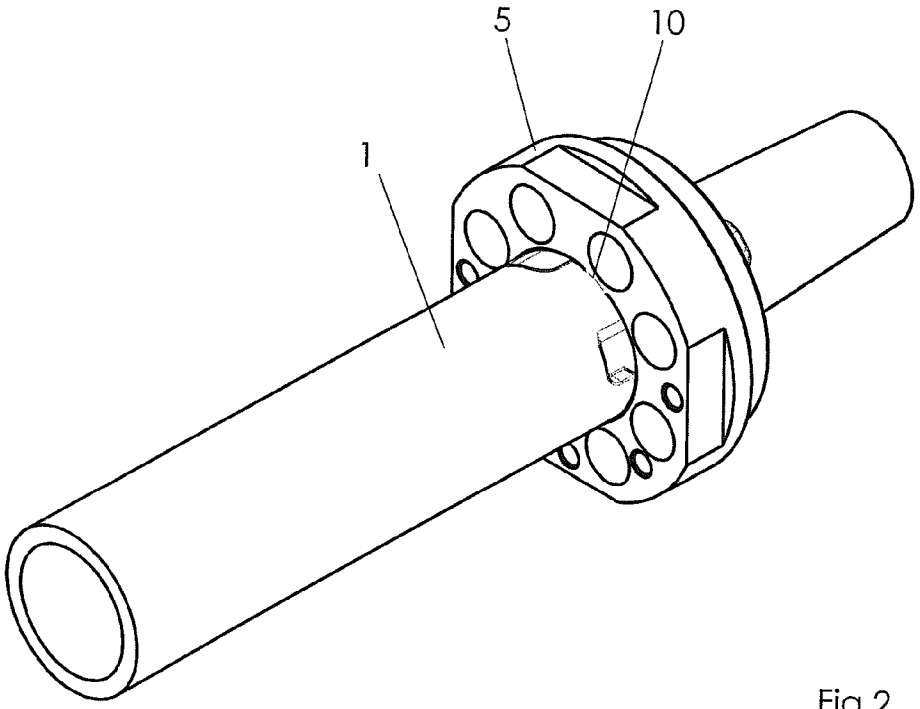
FIG. 2 shows the catch and the end-side area of the drill string section according to FIG. 1 in a mounted position in an isometric representation.

In FIG. 2, the catch 5 is shoved onto the seat 2 of the drill string section 1, and the aligning section 7 is positioned in an inner contour of the catch 5 such that there is a free passage for the aligning section 7 in the catch 5, and the catch 5 can be rotated relative to the drill string section 1 about the longitudinal axis of the drill string section 1. In the position of the catch 5 and drill string section 1 shown in FIG. 2, the drill string section 1 contacts the catch 5. A longitudinal movement stop surface 10 on the drill string section 1 limits the axial movement of the catch 5 while mounting, and serves as a contact when rotating. The rotation of the catch 5 relative to the drill string section 1 is limited by a rotational movement stop surface 14.

Figure 3:
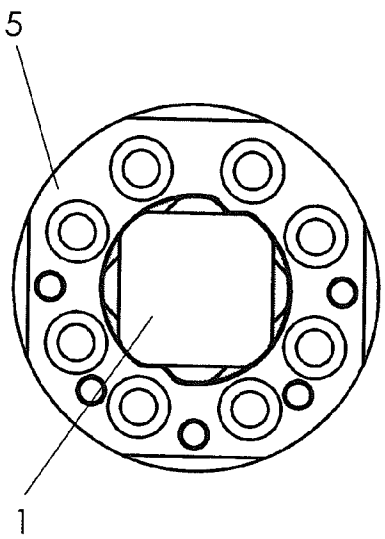
FIG. 3 shows a front view of the catch mounted on the drill string section according to FIG. 2.

FIG. 3 shows the drill string section 1 from the front with the catch 5 in the position from FIG. 2.

Figure 4:
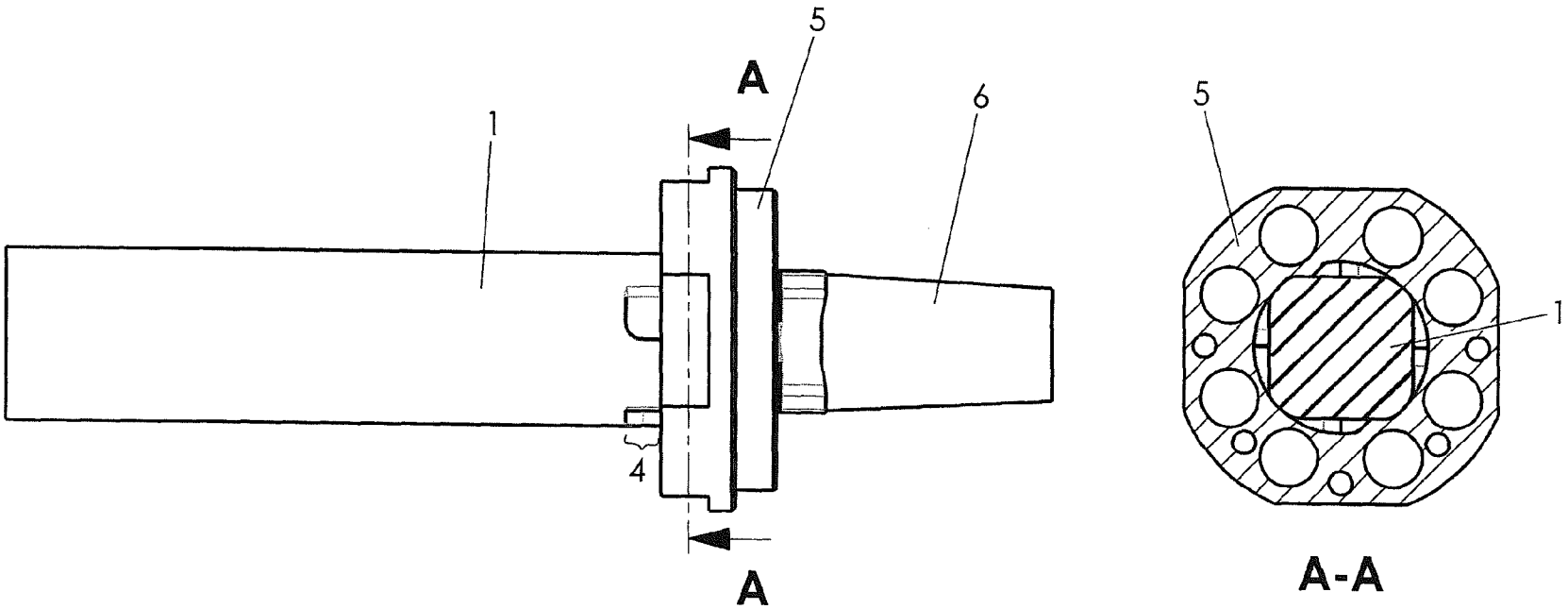
FIG. 4 shows a side view according to FIG. 2 and a sectional view.

FIG. 4 shows a side view of the catch 5 shoved on to the drill string section 1, as well as a sectional representation along plane A-A.

Figure 5:
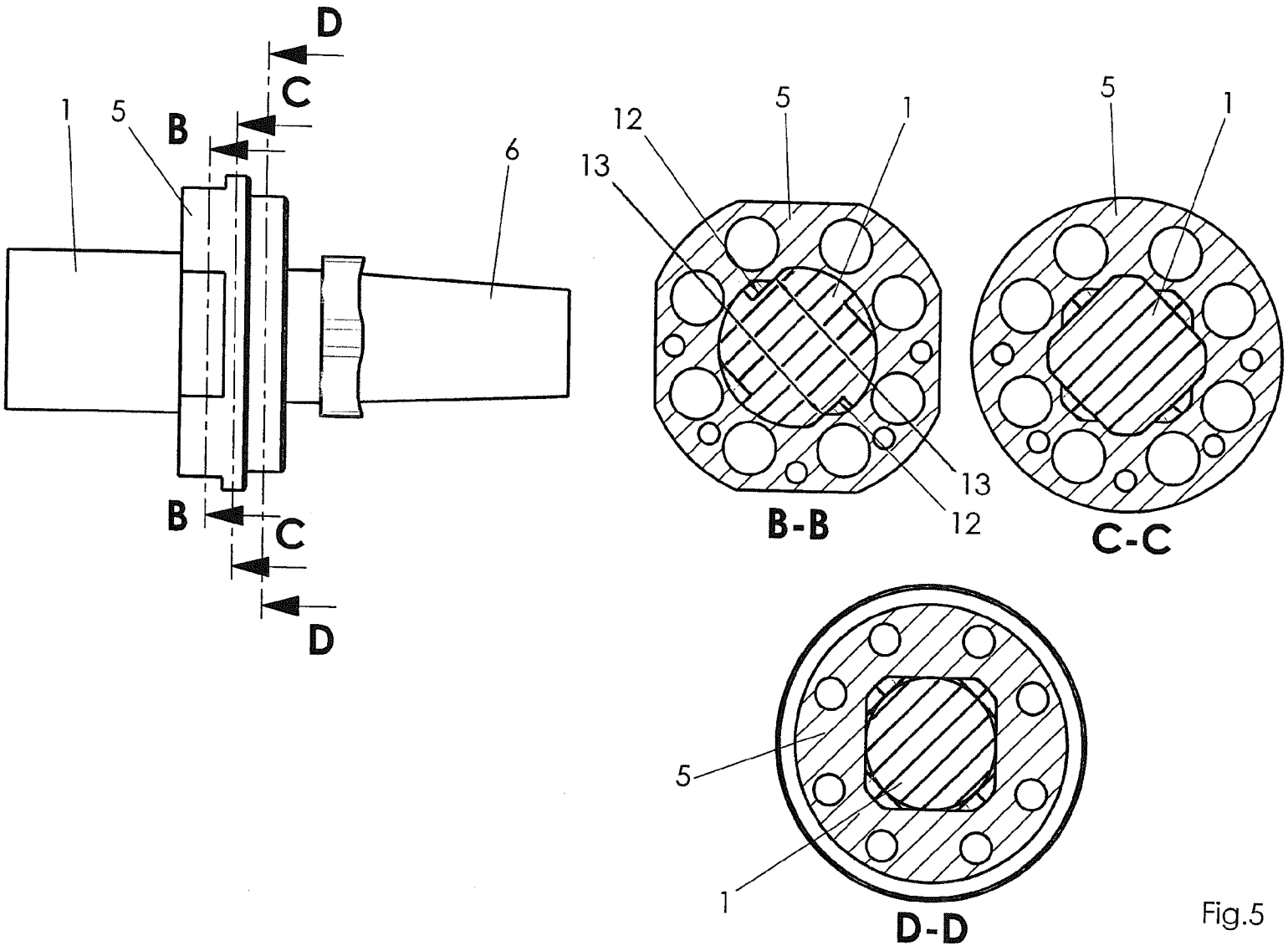
FIG. 5 shows a side view and sectional views of the catch and the drill string section after the formation of a connection secure against rotation.

FIG. 5 shows the catch 5 with the drill string section 1 after a rotation of the catch 5 relative to the drill string section 1 about the longitudinal axis of the drill string section 1, and an advancement of the catch 5 relative to the drill string section 1 in a side view and a sectional representation along the planes B-B, C-C and D-D indicated in the sectional representation. In the position of the drill string section 1 relative to the catch 5 shown in FIG. 5, the cutout in the catch 5 and the projections 11 formed on the aligning section 7 are no longer flush with each other so that, when the catch 5 is subject to tension relative to the drill string section 1, a tension-resistant connection exists. Under tension, the catch 5 contacts the projections 11 formed on the aligning section 7.

Furthermore, in the position shown in FIG. 5, a connection secure against rotation in both directions is formed between the catch 5 and the drill string section 1. The drill string section 1 has two paddle surfaces 12 which are in contact with rotational movement catch surfaces 13 formed on the catch 5.

What is claimed is:

1. A drill string section having a longitudinal axis and a plug-and-rotate seat for interacting with a catch, and an additional plug-in step for fixing the catch in a connection secure against rotation in both directions of rotation about the longitudinal axis of the drill string section, wherein the plug-and-rotate seat is configured to permit axial and radial motion of the catch relative to the seat, and wherein the additional plug-in step is configured to permit axial motion of the catch relative to the step independent of the axial and radial motion permitted by the plug-and-rotate seat.

2. The drill string section according to claim 1, wherein the seat comprises an aligning section, a rotating section and a paddle section.

3. The drill string section according to claim 1, wherein the seat has at least one axial contact surface and at least one paddle surface for the catch.

4. The drill string section according to claim 3, wherein two paddle surfaces are formed which are arranged at an angle offset to the longitudinal axis of the drill string section.

5. The drill string section according to claim 2, wherein the aligning section is configured to align the drill string section with the catch along the longitudinal axis, which section has a projection in an angular range about the longitudinal axis of the drill string section relative to the rotating section in which the catch is rotatable about the longitudinal axis of the drill string section.

6. The drill string section according to claim 5, wherein the aligning section for aligning the drill string section along the longitudinal axis is configured to be symmetrical.

7. The drill string section according to claim 5, wherein a longitudinal axial extension of the rotating section in which the catch is rotatable about the longitudinal axis of the drill string section substantially corresponds with the longitudinal axial extension of an inner contour of the catch.

8. The drill string section according to claim 1, further comprising an earth drilling device coupled to the drill string section for driving the drill string section.

9. A drill string section having a longitudinal axis and a plug-and-rotate seat for interacting with a catch, and an additional plug-in step for fixing the catch in a connection secure against rotation in both directions of rotation about the longitudinal axis of the drill string section, wherein the plug-and-rotate seat is configured to permit axial and radial motion of the catch relative to the seat and comprises an aligning section, a rotating section and a paddle section, and wherein the rotating section in which the catch is rotatable about the longitudinal axis of the drill string section has a longitudinal movement stop surface and a rotating movement stop surface which are arranged such that the catch, when brought into contact with the rotating movement stop surface, is out of contact with the longitudinal movement stop surface, and the catch is pluggable relative to the paddle section, and wherein the additional plug-in step is configured to permit axial motion of the catch relative to the step independent of the axial and radial motion permitted by the plug-and-rotate seat.

10. The drill string section according to claim 9, wherein the seat has at least one axial contact surface and at least one paddle surface for the catch.

11. The drill string section according to claim 10, wherein two paddle surfaces are formed which are arranged at an angle offset to the longitudinal axis of the drill string section.

12. The drill string section according to claim 9, wherein the aligning section is configured to align the drill string section with the catch along the longitudinal axis, which section has a projection in an angular range about the longitudinal axis of the drill string section relative to the rotating section in which the catch is rotatable about the longitudinal axis of the drill string section.

13. The drill string section according to claim 12, wherein the aligning section for aligning the drill string section along the longitudinal axis is configured to be symmetrical.

14. The drill string section according to claim 12, wherein a longitudinal axial extension of the rotating section in which the catch is rotatable about the longitudinal axis of the drill string section substantially corresponds with the longitudinal axial extension of an inner contour of the catch.

15. A connection system of an earth drilling device for connecting a drill string section, the system comprising a catch and a drill string section having a longitudinal axis and a plug-and-rotate seat for interacting with the catch, and an additional plug-in step for fixing the catch in a connection secure against rotation in both directions of rotation about the longitudinal axis of the drill string section, wherein the plug-and-rotate seat is configured to permit axial and radial motion of the catch relative to the seat, and wherein the additional plug-in step is configured to permit axial motion of the catch relative to the step independent of the axial and radial motion permitted by the plug-and-rotate seat.

16. The connection system according to claim 15, wherein the catch is formed on a drive and/or on another drill string section.

17. A method to connect a drill string section to a catch, comprising:

plugging in the drill string section relative to the catch in the longitudinal direction of the drill string section;

rotating the drill string section relative to the catch about the longitudinal axis of the drill string section; and after rotating the drill string section relative to the catch, plugging in the drill string section relative to the catch in the longitudinal direction of the drill string section, wherein the catch is brought into contact with the drill string section such that a connection secure against rotation is formed in both directions of rotation relative to the longitudinal axis of the drill string section.

* * * * *